US006742652B1

(12) United States Patent
Focke et al.

(10) Patent No.: US 6,742,652 B1
(45) Date of Patent: Jun. 1, 2004

(54) FOLDING BOX FOR CIGARETTES

(75) Inventors: Heinz Focke, Verden (DE); Henry Buse, Visselhövede (DE); Irmin Steinkamp, Seevetal (DE)

(73) Assignee: Focke & Co. (GmbH & Co.), Verden (DE)

( * ) Notice: Subject to any disclaimer, the term of this patent is extended or adjusted under 35 U.S.C. 154(b) by 146 days.

(21) Appl. No.: 10/048,853

(22) PCT Filed: Jul. 21, 2000

(86) PCT No.: PCT/EP00/07029

§ 371 (c)(1),
(2), (4) Date: Feb. 6, 2002

(87) PCT Pub. No.: WO01/12528

PCT Pub. Date: Feb. 22, 2001

(30) Foreign Application Priority Data

Aug. 17, 1999 (DE) ..... 199 38 196

(51) Int. Cl.[7] ..... B65D 85/10

(52) U.S. Cl. ..... 206/268; 206/273; 229/160.1; D27/189

(58) Field of Search ..... 206/268, 271, 206/273, 831, 242, 274; 229/146, 162, 160.1; D27/189, 186

(56) References Cited

U.S. PATENT DOCUMENTS

| | | | | | |
|---|---|---|---|---|---|
| 3,695,422 | A | | 10/1972 | Tripodi | |
| 4,620,664 | A | * | 11/1986 | Kaufman et al. | 229/233 |
| 4,948,038 | A | * | 8/1990 | Moeller | 229/146 |
| 5,137,148 | A | | 8/1992 | Evers | |
| 5,236,084 | A | | 8/1993 | Evers | |
| 5,363,955 | A | | 11/1994 | Fleenor | |
| 5,715,936 | A | * | 2/1998 | Focke et al. | 206/268 |
| 5,738,207 | A | * | 4/1998 | Trimani | 206/268 |
| 5,826,785 | A | | 10/1998 | Belvederi et al. | |
| 5,845,770 | A | * | 12/1998 | James et al. | 206/268 |
| D421,151 | S | * | 2/2000 | Luton et al. | D27/189 |
| D448,888 | S | * | 10/2001 | Focke et al. | D27/189 |
| 6,360,943 | B1 | * | 3/2002 | Focke et al. | 229/160.1 |

FOREIGN PATENT DOCUMENTS

| | | |
|---|---|---|
| BE | 739729 | 10/1969 |
| DE | 37 13 612 A1 | 11/1988 |
| DE | 42 37 523 A1 | 5/1994 |
| DE | 195 06 844 A1 | 8/1996 |
| DE | 198 58 781 A1 | 12/1999 |
| EP | 665 174 A1 | 8/1995 |

* cited by examiner

*Primary Examiner*—Jila M. Mohandesi
(74) *Attorney, Agent, or Firm*—Sughrue Mion, PLLC

(57) ABSTRACT

Folding box (hinge-lid pack) for cigarettes of the like, comprising a box component (10), a lid (11) and a collar (15), with a print carrier (28) being positioned in the folding box between a collar front wall (16) on one hand, and a box front wall 19, on the other hand. In a preferred embodiment, the folding box is provided with a window (34) in said area.

3 Claims, 5 Drawing Sheets

Figures 1, 2:
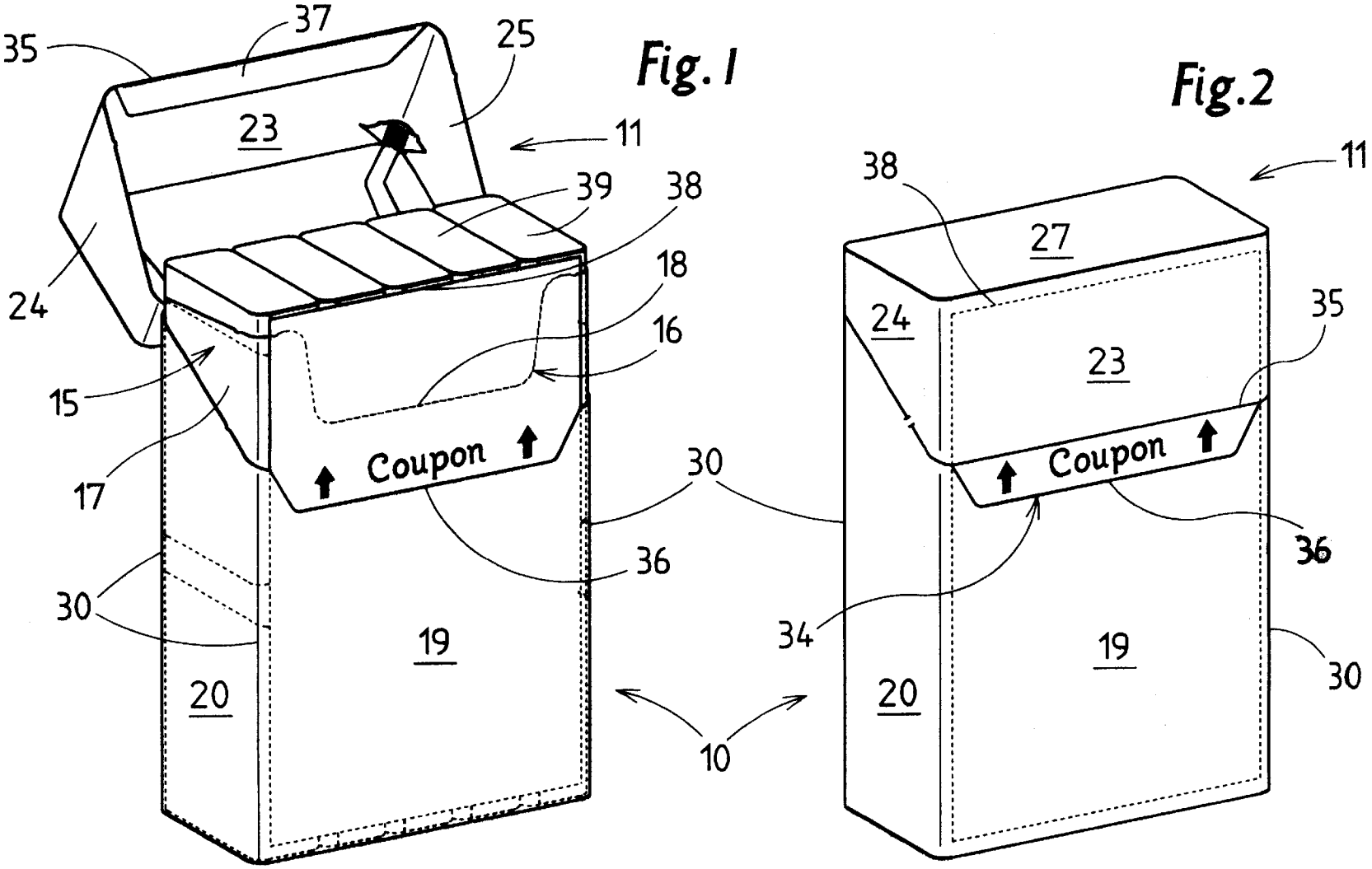

Coupon
Coupon
11
10
15
16
17
18
19
20
23
24
25
27
30
34
35
36
37
38
39

11
35
36
10
49
Coupon
42
23
19
45
46
24
43
44
40
20

15
17
16
10
36
40
49
25
48
11
23
42
Coupon
19
35
47
24
17
43
44
20

FOLDING BOX FOR CIGARETTES

DESCRIPTION

The invention relates to a folding box (hinge-lid pack), in particular for cigarettes, essentially comprising a box component, a hinged lid and a collar whose lower region is anchored in the box component, with a printing carrier or coupon made from a separate blank being arranged in the hinge-lid pack.

It is becoming more and more common in the cigarette industry to add carriers of printed information to cigarette packs in order to provide consumers with information or as coupons for participating in various events. The enclosure of the print carrier, designed as a separate blank, should be positioned to attract consumer attention but should also be easily integrated into the manufacturing process of the cigarette packs.

The invention has the objective of presenting an improved arrangement and presentation of a print carrier in a hinge-lid pack.

In order to achieve this objective, the hinge-lid pack is characterized in that the print carrier, or coupon, is positioned between a collar front wall of the collar, on one hand, and a box front wall of the box component, on the other.

The collar in hinge-lid packs is usually arranged with the collar front wall and collar side flaps in the box component and lying against the box front wall and box side walls. According to the invention, the print carrier is arranged between the collar front wall and box front wall, so that the collar front wall is preferably covered by the print carrier up to the upper margin of the pack contents (cigarette group). When the pack is used for the first time the print carrier is first pulled out and can thus fulfill its intended purpose.

Particularly advantageous is the invention's arrangement of the print carrier in hinge-lid packs which have an opening, or so-called window, in the region of the pack front side, namely between lid front wall and box front wall, which exposes part of the collar front wall when the hinge-lid pack is in a closed position.

According to the invention and its arrangement of the print carrier, the latter is visible from the outside in the region of the window, even when the hinge-lid pack is closed, so that information can be conveyed to the consumer for a closed pack or before it has been opened for the first time by means of the message printed on the print carrier in particular in the region of the window.

The invention's arrangement of the print carrier opens up new possibilities for connecting the collar with the box component, on one hand, and for the connecting the print carrier to parts of the hinge-lid pack.

Figure 3:
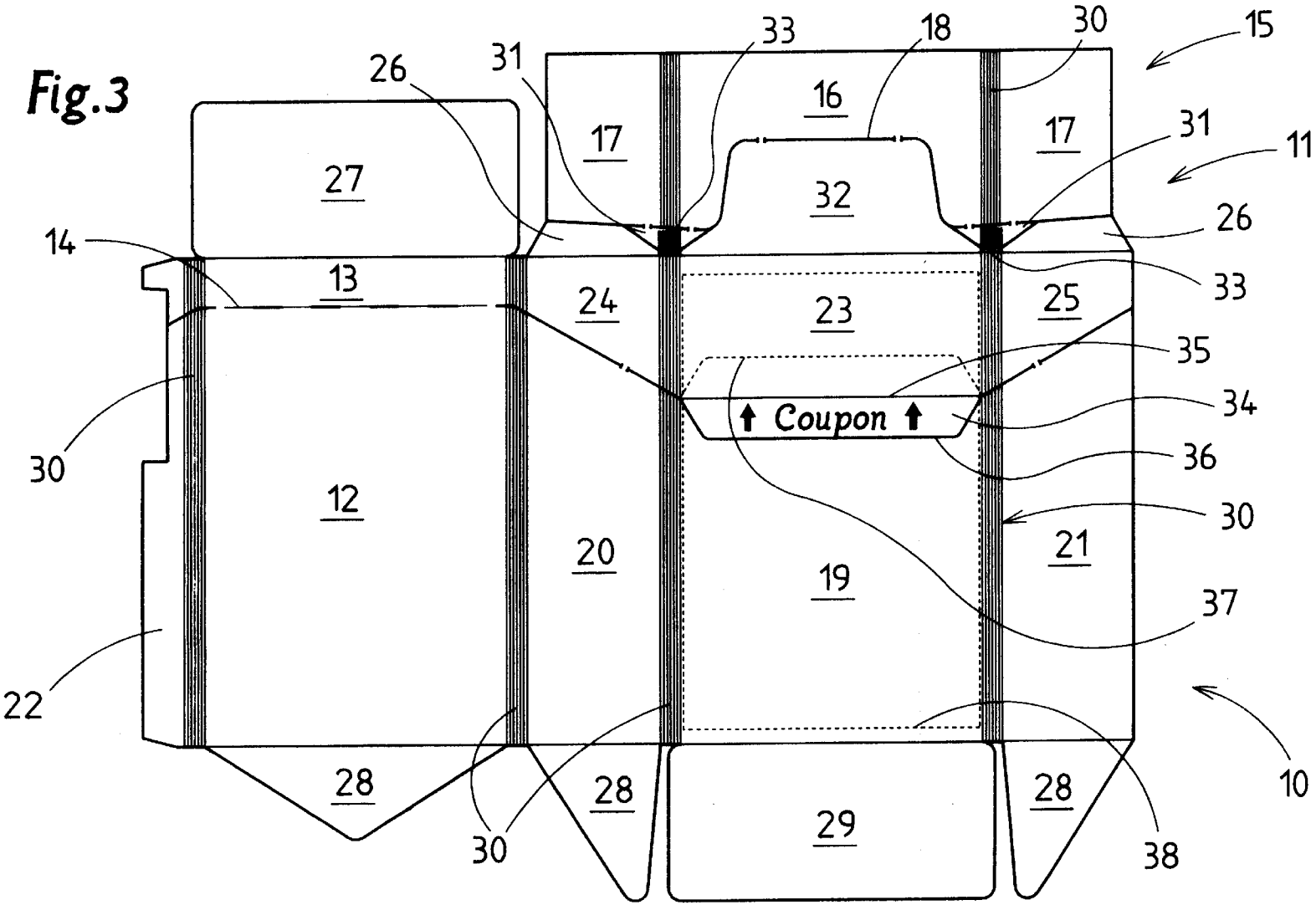
Figure 4:
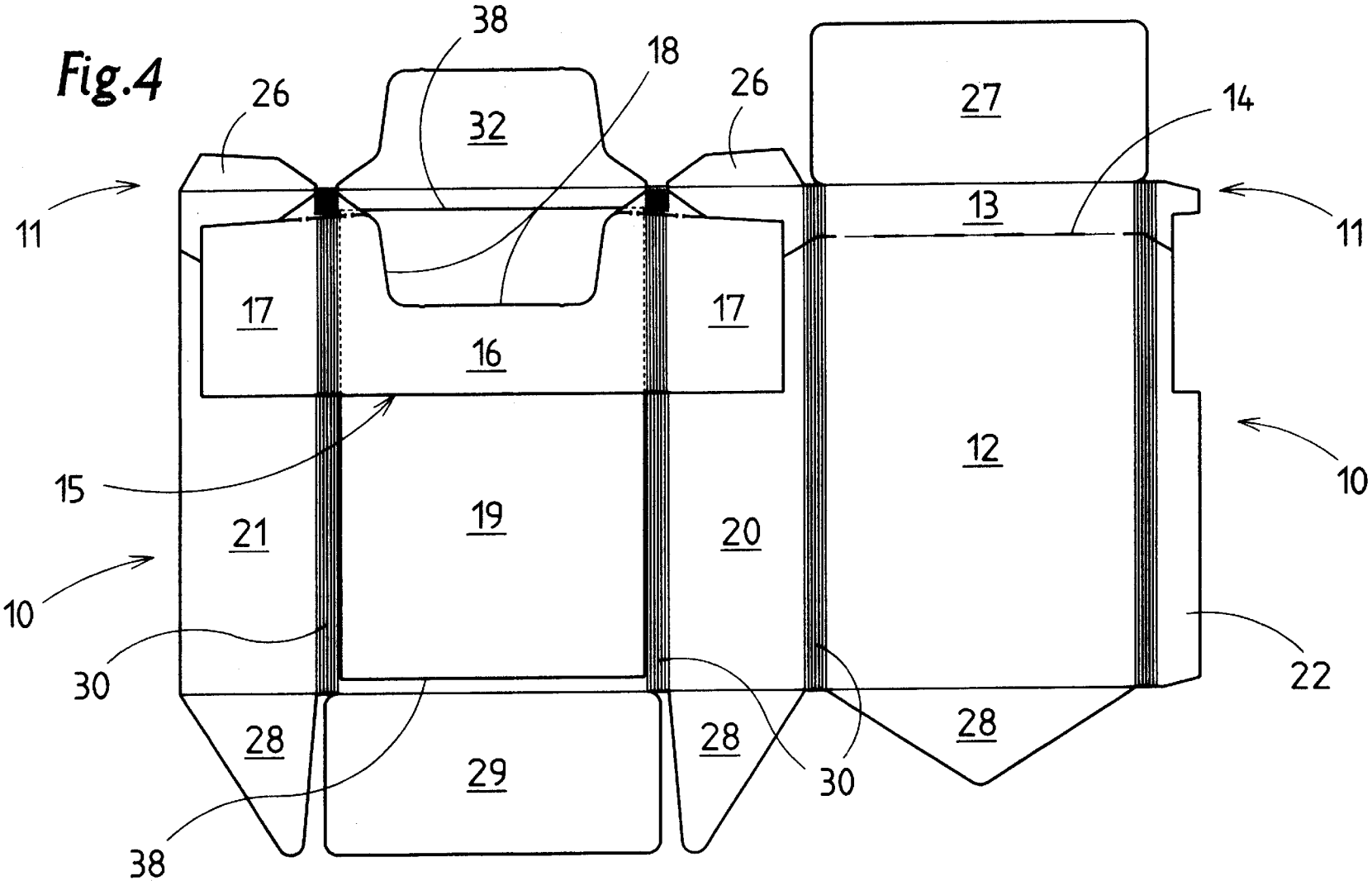
Figure 6:
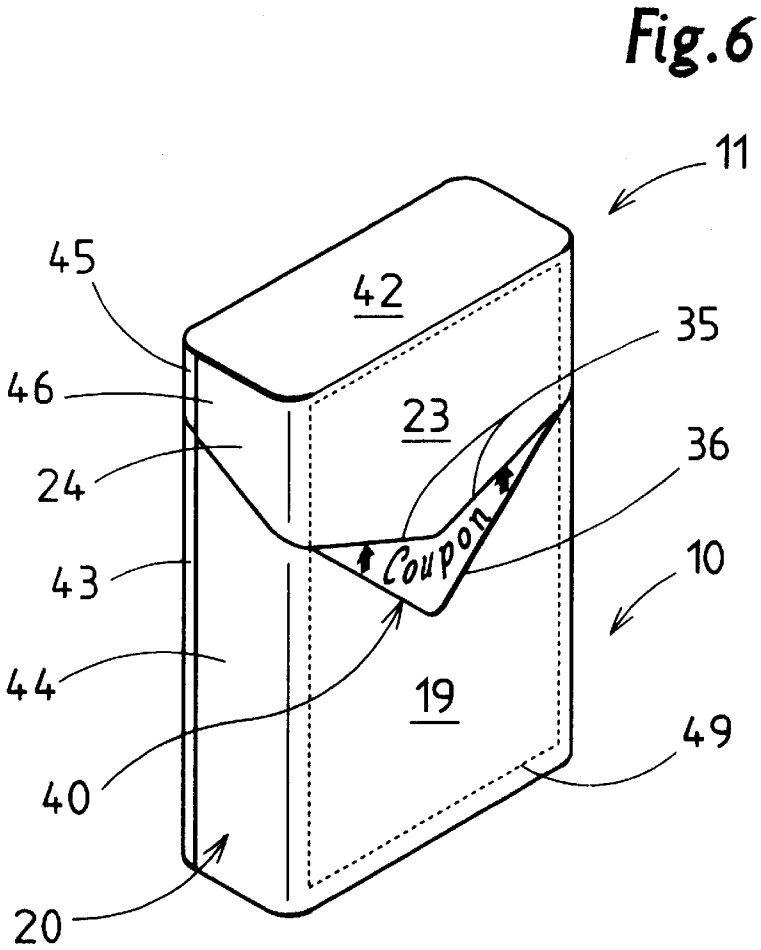
Figure 5:
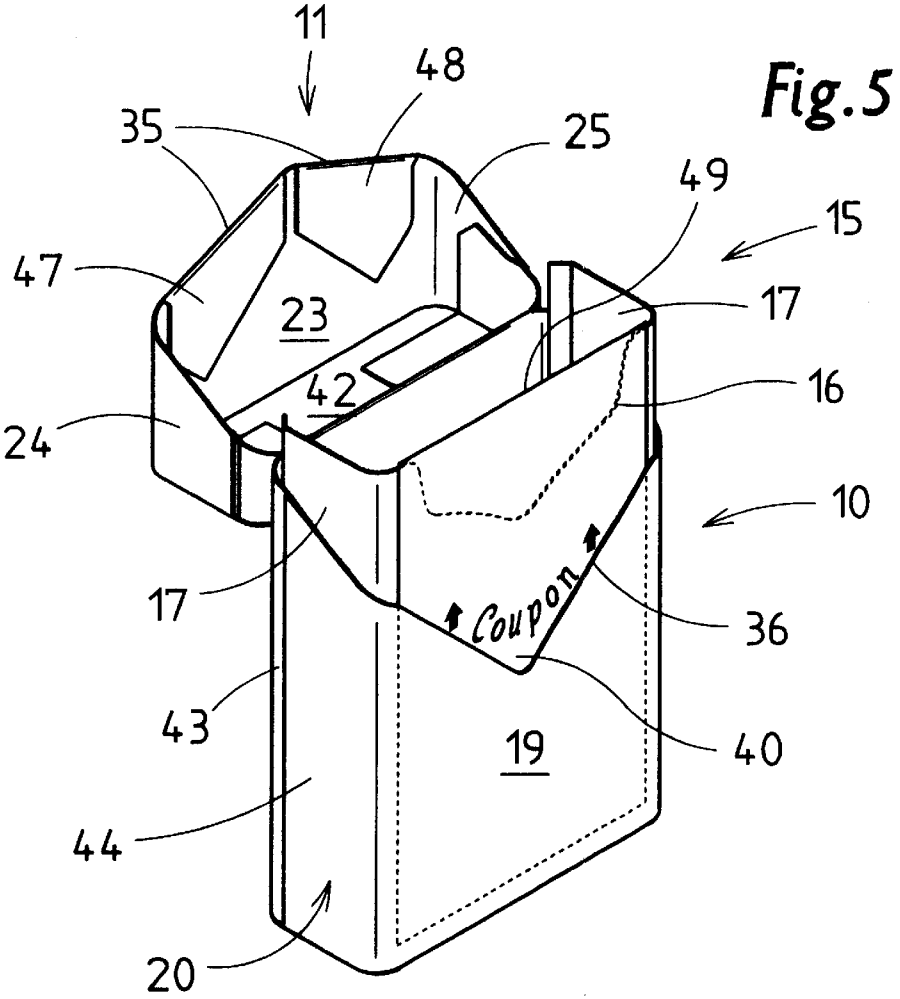
Figure 7:
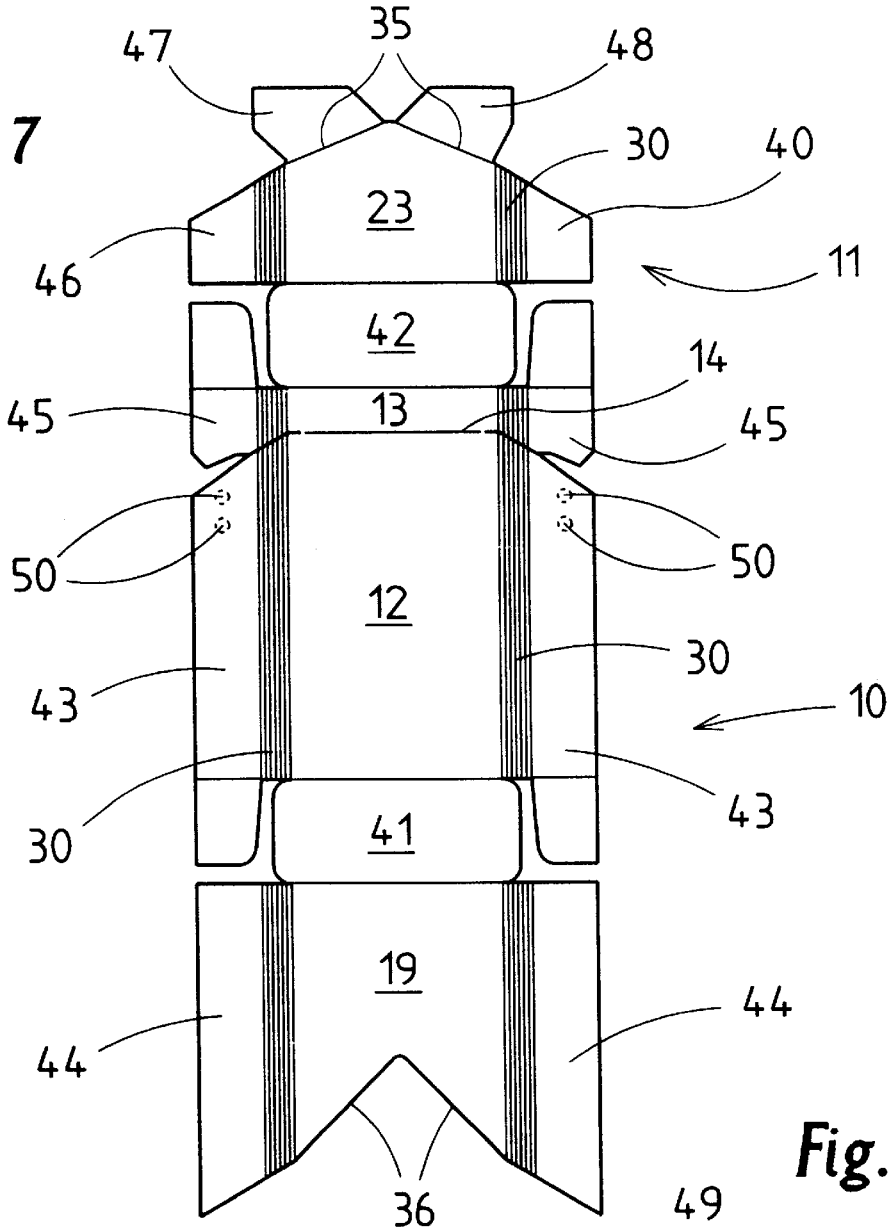
Figure 8:
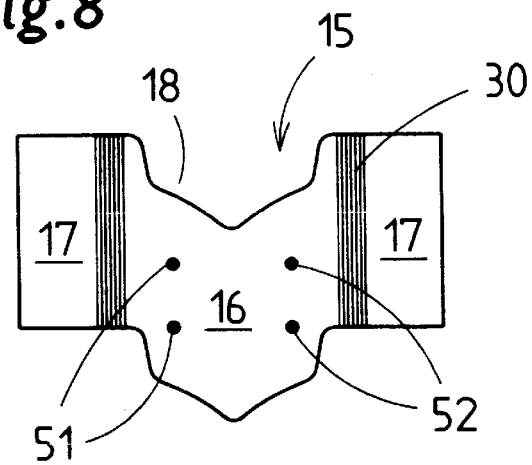
Figure 9:
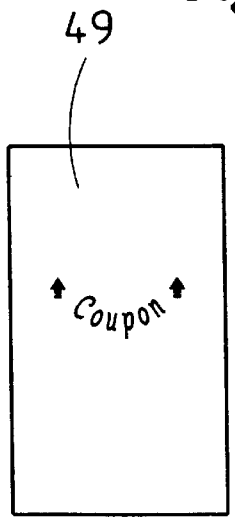

Further details of the invention will be presented below on the basis of exemplary embodiments of hinge-lid pack and their parts as illustrated in the drawings, which show:

FIG. 1 a (large-sized) hinge-lid pack as a bundle package for cigarette packs, in perspective view with open lid, FIG. 2 the hinge-lid pack from FIG. 1 in its closed position, FIG. 3 a spread-out blank for the production of a hinge-lid pack according to FIG. 1 and FIG. 2, FIG. 4 the blank from FIG. 3 in a view of the inner side of the blank, FIG. 5 perspective view of a hinge-lid pack for cigarettes with open lid, FIG. 6 the hinge-lid pack from FIG. 5 in its closed position, FIG. 7 a spread-out blank for a hinge-lid pack according to FIG. 5 and FIG. 6, FIG. 8 a spread-out blank for a collar as part of a hinge-lid pack according to FIG. 5 and FIG. 6, FIG. 9 a print carrier for the pack according to FIG. 5 and FIG. 6.

A folding box, or hinge-lid pack, made of (thin) cardboard usually comprises a (lower) box component 10 and a lid 11. The latter is connected to the box component 10 by a line hinge 14 in the region of a box rear wall 12, on one hand, and a lid rear wall 13, on the other.

A hinge-lid pack also includes a collar, comprising a collar front wall 16 and collar side tabs 17. The collar 15 in its standard form is configured such that a recess 18 is formed in the region of the collar front wall 16. This recess 18 extends in the upper region of the collar front wall 16 and facilitates access to the pack's contents, namely to the cigarettes. The collar 15 is positioned in the upper region of the box component 10 in such a manner that the collar front wall 16 faces a box front wall 19 and the collar side flaps lie against the box side walls 20, 21.

Hinge-lid packs can assume different configurations with respect to the design of the blanks. In the exemplary embodiment according to FIG. 1 to FIG. 4, the blank (FIG. 3, FIG. 4) or the pack made from it is constructed along the principle of transverse winding. The blank has adjacent regions for the box rear wall 12, the box front wall 19 and the box side walls 20, 21. Arranged at an exposed edge of the box rear wall 12 is a (narrow) connecting tab 22. In the finished hinge-lid pack it is connected to the inner side of the opposite box side wall 21.

The lid 11, being part of the blank, is configured analogously, with adjacent lid rear wall 13, a lid front wall 23 and lid side walls 24, 25.

Folding tabs for the top end wall, namely inner tab 26 and an outer lid tab 27, are connected to corresponding parts of the lid 11. Analogously arranged are base tabs, namely inner tab 28 and cover tab 29. The blank, or pack, is expediently configured according to specifications set forth in DE 199 12 995.9.

The collar 15 in the exemplary embodiment according to FIG. 1 to FIG. 4 is connected to the blank of the hinge-lid pack as one piece. In the region of the lid 11 the collar adjoins the inner tabs 26 but is separated from them by punched cuts. The connection with the box blank is made in the region of upright pack edges 30, which are here configured as rounded corners. Formed in the extension of these pack edges 30 at the lid end are triangular connecting gussets 31, which ensure the stable connection with the pack blank. Furthermore, formed at the transition to the lid front wall 23 is another inner tab 32 of the end wall. This has a contour which matches that of the recess 18 in the collar front wall 16.

In the production of the hinge-lid pack according to FIG. 1 to FIG. 4 the collar 15 is first crimped against the inner side of the blank, with the connecting gussets 31 being crimped in the region of a hinge connection 33. After this folding step (FIG. 4) the collar 15 assumes a position for fitting into the pack. The connection with the inner tab 32 is thereby eliminated, thus exposing this inner tab 32 as part of the end wall. The blank can now be folded in the usual manner in order to create a hinge-lid box according to FIG. 1 or FIG. 2.

The hinge-lid pack exhibits a window 34 as a special feature. This window 34 is formed in the region of the pack front side, namely between the lid front wall 23 and the box front wall 19. The window is generated by means of a space existing between a closing edge 35 of the lid 11 and a counter-closing edge 36 of the box component 10. Both closing edges 35, 36 are arranged at a distance from one another and contoured if necessary.

In the present exemplary embodiment the window 34 is created by the formation of a lid inner tab 37. This is located at the inner side of the lid front wall 23 and is connected thereto. Within the blank (FIG. 3, FIG. 4) the lid inner tab 37 is defined as a subregion of the box front wall 19 by a corresponding stamped line. In a first folding step (FIG. 3) the lid inner tab 37 is folded against the inner side of the lid front wall 23 (FIG. 3). Then the remaining folding steps are carried out.

The hinge-lid pack is provided with an enclosure, namely with a print carrier 38 formed from a separate blank. This is made of paper or thin foil and is printed on one or both sides with information, advertisements, etc. Here the print carrier 38 is configured as a rectangular blank and positioned within the hinge-lid pack on its front side. The special feature is that the print carrier 38 lies between the collar 15 or collar front wall 16, on one hand, and the box front wall 19, on the other. With the corresponding dimensions being applied, the collar front wall 16, including the recess 18, are therefore covered by the blank or print carrier 38 (FIG. 1). In the shown exemplary embodiment, the print carrier 38 is sized so that it extends approximately across the full height and width, at a slight distance in each case from the bottom wall, on one hand, and the top end wall, on the other. In hinge-lid packs having rounded corners or beveled edges (octagonal pack) the print carrier 38 extends, in an expedient manner, beyond the corresponding pack edges 30 thus formed.

The print carrier 38 is also located in the region of the window 34 and is expediently provided in this region with compact, informational material. When the lid 11 is opened, an upper region of the print carrier 38 is completely exposed and, due to its positioning in front of the collar 15, it can be easily removed, namely pulled out of the pack.

In the example according to FIG. 1 to FIG. 4, the hinge-lid pack has a large-size format and is used to receive a group of cigarette packs 39. These are positioned in two groups of five cigarette packs 39 lying one above the other within the hinge-lid pack, it is therefore possible to position a relatively large-surface print carrier 38 inside the hinge-lid pack.

FIG. 5 to FIG. 9 relate to details of a hinge-lid pack for cigarettes whose basic construction is formed in the conventional manner, but whose upright pack edges 30 take the form of rounded corners. Furthermore, a specially designed window 40 is formed at the front side of the package. This window 40 has an almost V-shaped contour with the corresponding V-shaped closing edge 35 and counter-closing edge 36.

The blank for the package is configured in the conventional manner according to the bottom fold principle (FIG. 7). Box front wall 19, box rear wall 12, lid rear wall 13 and lid front wall 23 are arranged in succession in the longitudinal direction of the blank. Furthermore, a bottom wall 41 and an top end wall 42 are arranged in this order. In the present case, box side walls and lid side walls each comprise two box side tabs 43 and 44 lying one above the other, as well as the corresponding lid side tabs 45, 46. In the present case, a lid inner tab consists of two partial tabs 47, 48 directed toward each other at an angle.

In this embodiment of a folding box, the collar 15 comprises a special blank (FIG. 8). The collar is positioned within the box component 10 in the described usual manner. The recess 18 in the collar front wall 16 conforms to the (V-shaped) form of the closing edges 35, 36.

In this folding box as well a print carrier 49 is positioned between collar front wall 16 and box front wall 19, preferably across the full width of the package or to the upper limit of the collar 15. The print carrier 49 is visible in the region of the window 40.

By virtue of the arrangement of the print carrier 38, 49, which essentially extends across the full width of the front side of the package, a connection of the collar 15 to the box component 10 is possible only in the region of the collar side tabs 17. The box side walls 20, 21 or the inner box side tabs 43 are provided with glue patterns on their inner sides, in the present case with two glue beads 50 arranged one above the other. These are preferably applied on the inner side of the individual blanks before the blanks are fed to a folding turret. The collar 15, which is usually fed along with the pack contents (cigarette block), is in the exemplary embodiment according to FIG. 5 to FIG. 9 connected to the hinge-lid pack or to the box side walls 20, 21 by means of the glue beads 50.

Alternatively, print carriers 38, 49 can be used having a width less than that of the collar front wall 16 so that when the print carriers 38, 49 are centered lateral regions of the collar front wall 16 are exposed. Glue patterns can be provided here. In the exemplary embodiment of FIG. 8, two glue beads 51, 52 each have been arranged at either side of a more narrow print carrier 49 (not shown). In this embodiment the print carrier can also be folded in the transverse direction.

The production of hinge-lid packs with print carrier 38, 49 can be carried out in a different manner. In the exemplary embodiment according to FIG. 1 to FIG. 4, the print carrier 38 is laid onto the inner side of the largely non-folded blank (FIG. 3) (dashed lines). Prior to this, however, the lid inner tab has already been folded. In this position the print carrier 38 can be fixed by glue beads which are easily detachable, i.e. which have only slight adhesive power. But it is also possible to fix the print carrier 38 in the shown position by using glue beads of the "stick-no-stick" variety. This (known) type of glue is designed to exert an adhesive or joining effect for a limited period of time. Afterwards the glue disintegrates or the adhesive effect ends.

Using this type of glue it is possible to fix the coupon 49 with the help of glue beads 51, 52 to the outer side of the collar 15 or collar front wall 16 during the production period of the package. Expediently, this is carried out so that the collar 15 is joined in the usual manner to the pack contents—cigarette block—by being laid upon the latter and then the print carrier 49 is laid on the upwardly directed collar front wall 16 and held in place by the glue beads 51, 52. The unit of cigarette block, collar 15 and print carrier 49 formed in this manner is then fed to the partially folded package.

The print carrier 49 can also be joined in practical fashion to an inner wrapper of the cigarette group common to hinge-lid packs (tin foil, paper or film). The inner wrapper is usually provided with a pull tab in the region of its front side (so-called flap). The upper region of the print carrier 49 can be connected to this so that when the flap is pulled out when the cigarette pack is used for the first time the print carrier 49 is automatically drawn out of the pack.

The hinge-lid pack can be configured in a different manner with respect to the design of the window 34 or 40, in particular to conform to the design of the print carrier 38, 49. Examples for the form of the window are disclosed in DE 198 58 786.4.

List of designations

| | | | |
|---|---|---|---|
| 10 | box component | 32 | inner tab |
| 11 | lid | 33 | hinge connection |
| 12 | box rear watt | 34 | window |
| 13 | lid rear watt | 35 | closing edge |
| 14 | line hinge | 36 | counter-closing edge |
| 15 | collar | 37 | lid inner tab |
| 16 | collar front wall | 38 | print carrier |
| 17 | collar side tabs | 39 | cigarette pack |
| 18 | recess | 40 | window |
| 19 | box front wall | 41 | bottom wall |
| 20 | box side wall | 42 | top end wall |
| 21 | box side wall | 43 | box side tab |
| 22 | connecting tab | 44 | box side tab |
| 23 | lid front wall | 45 | lid side tab |
| 24 | lid side wall | 46 | lid side tab |
| 25 | lid side wall | 47 | partial tab |
| 26 | inner tab | 48 | partial tab |
| 27 | cover tab | 49 | print carrier |
| 28 | inner tab | 50 | glue bead |
| 29 | cover tab | 51 | glue bead |
| 30 | pack edge | 52 | glue bead |
| 31 | connecting gusset | | |

What is claimed is:

1. A hinge-lid pack for cigarettes, comprising a box component (10), a lid (11), and a collar (15) anchored in the box component with a collar front wall (16) and collar side tabs (17), with a print carrier (38, 49) or coupon being arranged in the hinge-lid pack, characterized by the following features:

a) the printing carrier (38, 49) or coupon is a separate blank, b) a closing edge (35) formed by a lid front wall (23) is arranged at a distance from a counter-closing edge formed by an upper edge of a box front wall (19) in such a way that a window (34, 40), delimited by said closing edge (35) and said counter-closing edge (36), is formed on the front side of the hinge-lid pack, c) the print carrier (38, 49) is positioned between the collar front wall (16) and a box front wall (19) of the box component (10), d) the collar (15) is connected to the box component (10) exclusively in a region of the collar side tabs (17) by adhesive bonding, and e) the print carrier (38, 49) extends across approximately the full height of the hinge-lid pack in such a way that a region of the print carrier (38, 49) is visible in a region of the window (34, 40) when the hinge-lid pack is closed.

2. The hinge-lid pack according to claim 1, characterized in that the print carrier (38, 49) extends across a full width of the collar front wall (16).

3. The hinge-lid pack according to claim 1, characterized by the following features:

a) the print carrier (49) has a smaller width than the full width of the collar front wall (16), the print carrier (49) is centered on the collar front wall, and on an outer side of the collar, there are glue beads (51, 52) which fix the print carrier (49) to the collar.

* * * * *